US005782570A

United States Patent [19]

Masterson et al.

[11] Patent Number: 5,782,570

[45] Date of Patent: Jul. 21, 1998

[54] ALIGNMENT OF ATTACHMENT(S) MOUNTED ON A POWER TOOL

[75] Inventors: Peter A. Masterson, New Hartford, N.Y.; Carl R. Muha, Jr., Woodbury, Minn.

[73] Assignee: Chicago Pneumatic Tool Company, Rock Hill, S.C.

[21] Appl. No.: 735,678

[22] Filed: Oct. 23, 1996

Related U.S. Application Data

[63] Continuation-in-part of Ser. No. 546,935, Oct. 23, 1995, abandoned.

[51] Int. Cl.[6] ..... B25G 3/12

[52] U.S. Cl. ..... 403/13; 403/225; 403/365; 81/177.85

[58] Field of Search ..... 403/11–14, 24, 403/365, 228, 372, 220, 221, 223, 225, 224, 371; 81/177.85, 177.1, 463, 464, 436, 439; 173/93, 93.5, 104, 176, 178

[56] References Cited

U.S. PATENT DOCUMENTS

| | | | |
|---|---|---|---|
| 2,549,397 | 4/1951 | Sparks | 81/177.85 X |
| 2,832,245 | 4/1958 | Burrows | 403/225 X |
| 2,870,809 | 1/1959 | Feldman et al. | 81/436 X |
| 3,222,096 | 12/1965 | Kaman | 81/177.85 X |
| 3,288,002 | 11/1966 | Mankovitz | 81/436 |
| 4,051,905 | 10/1977 | Kleine | 173/104 |
| 4,492,129 | 1/1985 | Hasegawa | 403/372 X |
| 4,754,670 | 7/1988 | Raymond | 81/177.85 X |
| 4,825,732 | 5/1989 | Arnold | 81/177.1 X |
| 4,840,094 | 6/1989 | Macor | 81/177.85 X |
| 5,038,869 | 8/1991 | Olson | 81/177.85 X |
| 5,213,347 | 5/1993 | Rulon et al. | 81/177.85 X |
| 5,509,333 | 4/1996 | Rion | 81/177.85 X |

FOREIGN PATENT DOCUMENTS

| | | | |
|---|---|---|---|
| 568635 | 1/1959 | Canada | 81/177.85 |

*Primary Examiner*—Harry C. Kim

*Attorney, Agent, or Firm*—Schmeiser, Olsen & Watts

[57] ABSTRACT

An alignment device for power tools is disclosed comprising a power tool attachment, typically a socket or an extension and an alignment ring mounted on an output shaft. The alignment ring is placed between the output shaft and a socket or extension. The alignment ring reduces the motion between the socket and the output shaft, thereby reducing wear on both the socket and the output shaft. Also, the use of the alignment ring allows the energy of the tool to be used in improving torque.

6 Claims, 4 Drawing Sheets

ALIGNMENT OF ATTACHMENT(S) MOUNTED ON A POWER TOOL

RELATED APPLICATIONS

This application is a continuation-in-part of patent application Ser. No. 08/546,935 filed on Oct. 23, 1995, now abandoned.

BACKGROUND OF THE INVENTION

1. Field of the Invention

This invention relates generally to power tools. More particularly, this invention relates to alignment and vibration reduction of an attachment, such as sockets and extensions, coupled to another attachment, such as an extension, or the output shaft such as an anvil, of a power tool.

2. Description of Related Art

Heretofore, coupling attachments (e.g., sockets and extensions) to another attachment (e.g. extension) or an output shaft (e.g., an anvil) of a power tool (e.g., impact wrench, nutrunner, or pulse tool) is commonly achieved by a bore in the attachment mating with the drive of an extension or the output shaft of the power tool. A recurring difficulty with the coupling (e.g., socket-output shaft, extension-output shaft, and socket-extension) of these attachments is that typically large tolerances exists or are formed between the bore of the attachment and the output shaft of the power tool. Loose tolerances allow undesirable alignment between the tool and the fastener and undesirable vibration to occur at the attachment. Some of the difficulties with loose tolerances include: 1) erratic rotation of the attachment due to improper alignment; 2) surface wear of the attachment at a fastener/socket interface; 3) surface wear at an attachment/attachment interface; 4)surface wear at an attachment/output shaft (of the power tool) interface; and 5) reduced life of the power tool due to the associated vibrational stresses; and 6) misalignment and torque. Other difficulties with current alignment devices include: 1) inability to adapt to output shafts of varying sizes; 2) an alignment device which does not permit the user to manipulate a pin retainer; and 3) an alignment device which prevents the alignment device from vibrating out of the attachment device during use. Surface wear at any of the above interfaces reduces the effectiveness of the power tool by reduced alignment, increased vibration, and reduced torque.

Various types of devices have been arrived at to address these difficulties. For example, extensions produced by Cooper Industries, Snap-On, and URYU address the issue of alignment and vibration reduction by specially designed extension bars for deeper engagement with the output shaft of the power tool. For example, most sockets and extensions on the market today are adapted to engage only the square drive portion of the output shaft of a power tool. The Cooper Industries, Snap-On and URYU extensions have bores sufficient to pilot the attachment just beyond the square drive onto the body of the output shaft. While this improves alignment and torque and decreases vibration, this extension device may not be used with a wide array of tools, each socket and extension is specifically designed for a specific tool. Thus, a need exists to provide an alignment device that will reduce vibration and compensate for varying outside diameters on the portion of the output shaft behind the typically square drive.

The following patents include anti-vibration devices and are hereby incorporated by reference. U.S. Pat. No. 4,251,113 to Mitin et al. discloses a hammer for breaking down strong abrasive materials. The hammer includes a body; a ram having a socket in its front end; a drive for reciprocating said ram; and a tool. The tool includes a shank and a working portion and secured by its shank in said ram socket. An elastic gasket installed in said ram socket separates the tool shank and ram socket. The provision of the elastic gasket between the side surface of the socket of the ram and the side surface of the shank of the tool conducts, during "oblique" blows, to create a more uniform distribution of load among said side surfaces which, in turn, raises the reliability of the disclosed device.

U.S. Pat. No. 3,783,970 to Danielson discloses a sound attenuating device for a pneumatically operated paving breaker, or the like. The device includes a tubular member in the form of a cylindrical, metal sleeve having an inside diameter that is somewhat greater than the outside diameter of the shaft of a work steel or tool. For example a moil point, so as to provide a clearance therebetween when the sleeve is mounted on the tool. A sound attenuating material liner, preferably an elastomeric such as natural gum rubber, is secured to the inner surface, of the sleeve.

AIMCO Corporation produces an extension and socket system. The extension and socket system of AIMCO Corporation includes a first bore for insertion of a square drive of an output shaft of a power tool extension and a second bore for insertion of an O-ring and the extension shaft. The AIMCO device has the advantage of reducing vibration and improving alignment, however, it is not adaptable to various sized output shafts of a power tool. Since the inner diameter of the O-ring is fixed, the AIMCO device requires using a dedicated socket for use on a single configuration of an output shaft. This drastically increases the number of parts necessary for any given torquing scenario where more than one tool would be used.

SUMMARY OF THE INVENTION

This invention is intended for use on power tools, such as pneumatically powered tools. This invention encompasses a modified power tool attachment, such as a socket, and an interchangeable alignment member, typically made of rubber, which are used in conjunction with the output shaft of the power tool. The attachment modification involves adding length to the attachment behind the bore for insertion of the output shaft of the power tool and boring the back end of the socket to a standardized inner diameter. The alignment member includes a standardized outer diameter to fit into the bore of the socket with an interference fit and the inner diameter of the ring will be shaped to accommodate the contours of the output shaft for which it is designed. There will also be an interference fit between the output shaft and the alignment member. Thus all surfaces of the alignment member are positively engaged to the attachment and the output shaft. The alignment member includes locking members or small nubs which engage in corresponding holes in the bore of the attachment to eliminate any relative movement of the alignment member in relation to the attachment or the output shaft. The alignment member will be made to be easily removable from the attachment when the output shaft is not engaged into the alignment member. This is due to the pliability of material used for the alignment member, such as rubber. A slot is formed in the alignment member to allow the use of pin retainer square drives found on some power tools. The slot permits a pin to be inserted therethrough to depress the pin retainer. The invention has several advantages over a standard attachment, such as a socket, configuration. This invention has the effect of reducing vibration experienced by the tool user. The invention can also increase and make more consistent the torque output of the power tool. There are other devices available which accomplish these goals but this invention has other features which make it unique and more valuable than the current state of the art. Other vibration reduced socket systems involve using a dedicated socket for each tool it is to be used on. This invention allows each socket to be used on any power tool of the same square drive size with just the simple change of the alignment ring. This drastically reduces the number of parts necessary for any given torquing scenario where more than one tool would be used. The socket in this invention can also be used alone without the ring for a standard socket torquing situation (as long as the tool it is used on has sufficient length exposed behind the square drive). Other vibration reduced sockets are not typically usable on any tool for which it was not designed. The choice of rubber for the ring material allows for less precise tolerances. Other vibration reduced sockets require tighter tolerances. Rubber also has an advantage over other materials since it can be made with various vibration absorbing properties. Thus, the alignment ring can provide stiffness and damping to the modified socket in its relationship to the anvil of the power tool. This invention is designed to be compatible with square drives with both ring retainers or pin retainers.

This invention includes all of these advantages over previous devices; 1) reduce erratic rotation of the attachment due to improper alignment; 2) reduce surface wear at a fastener/socket interface; 3) reduce surface wear at an attachment/attachment interface; 4) reduce surface wear at an attachment/output shaft interface; 5) improve life of the power tool due to reduction in the associated vibrational stresses; 6) increase alignment and torque; 7) adaptability to output shafts of varying sizes; 8) ability of an alignment device which permits the user to manipulate a pin retainer; and 9) ability of an alignment device to grip an attachment device to prevent the alignment device from vibrating out of the attachment device during use.

BRIEF DESCRIPTION OF THE DRAWINGS

These and other advantages of the present invention will become more readily apparent upon reading the following detailed description and upon reference to the drawings in which.

DETAILED DESCRIPTION OF THE PREFERRED EMBODIMENT(S)

Figure 1:
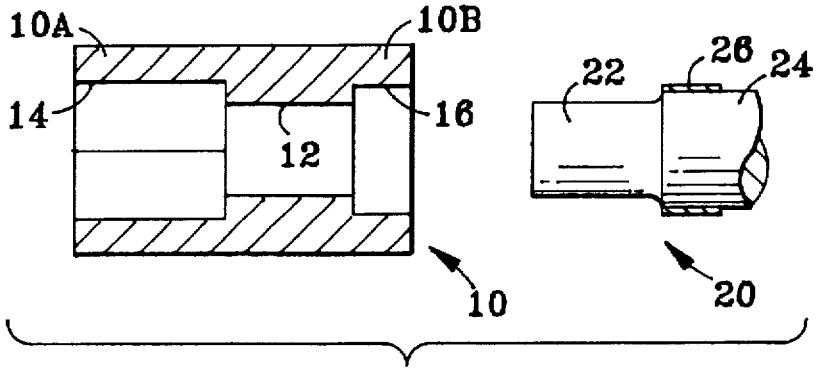
FIG. 1 is a partial cross-sectional, exploded view of an alignment device of a first preferred embodiment of the present invention as used in conjunction with a socket.

Referring now to the drawings, more specifically FIG. 1, there is shown a first preferred embodiment of the present invention. A power tool attachment 10, in this case a socket, and an output shaft 20 are shown. The output shaft 20 is the portion of an anvil 142 that extends beyond the housing 102 of a power tool 100 as shown in FIG. 5. The power tool attachment 10 may be a socket (FIGS. 1 and 2), an extension (FIG. 4), or any other tool adapted for attachment to the output shaft 20 of a power tool.

The output shaft 20 comprises a drive 22, typically square in shape, and a body 24, typically circular, integrally connected to the drive 22. An alignment device, such as a ring 26, is interference fit to the body 24, and is seated just behind the drive 22. The ring may also be bonded to the anvil or extension with an adhesive material or the ring may be an integral portion of the body 24 of the output shaft 20. Additionally, the ring 26 is formed fit into a bore of the socket 10.

Figure 2:
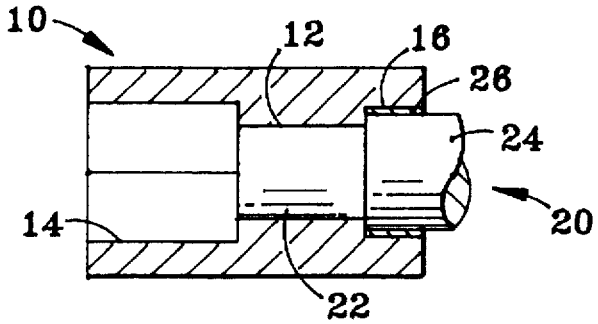
FIG. 2 is a partial cross-sectional view of the first preferred embodiment of the present invention shown in its operative mode.

The power tool attachment or socket 10, comprises a second end 10A and a first end 10B. As shown in FIGS. 1 and 2, the second end 10A is a socket having an inner bore 14. The most common shape of the inner bore 14 is a hex shape, however, other shapes, such as octagonal, twelve point or splines, are also known in the art. The second end 10A may also be any other tool end commonly known to work on a threaded fastener. The first end 10B comprises a first bore 12 and a second bore 16 in consecutive, axial alignment. The first bore 12 is adapted to fit the drive 22 of the output shaft, and is therefore typically square in shape. A slip fit or mild interference fit between the first bore 12 and the drive 22 is the desired fit so that the power tool attachments may be readily interchanged. The second bore 16 has a diameter corresponding to the outer diameter 26A (FIG. 3) of the alignment ring 26. This second bore 16 is manufactured with a tolerance such that it uniformly loads the ring in order to prevent vibration and decreases slippage of the attachment relative to the output shaft. For example, if rubber is used, the ring need not be precisely fit because of its compressive nature. If metal or plastic is used, it must have a precise fit for uniform loading.

Figure 3:
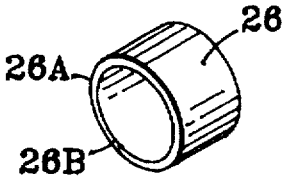
FIG. 3 is a perspective view of a first embodiment attachment device of the present invention.

As shown in FIG. 3, the alignment ring 26 has an outer diameter 26A and an inner diameter 26B and has an axial length shorter than the output shaft. The alignment ring 26 is preferably made of a vibration absorbing material, such as nitrile rubber. However, the ring 26 may be made of other materials, such as metal or plastic, having sufficient stiffness to maintain alignment. If a rigid material is used, it must be precisely fit with exact tolerances. If the tolerances are too tight the ring will not fit. If the tolerances are too loose, excessive vibration will occur.

The outer diameter 26A is standardized to fit the second bore 16 of any number of attachments 10, so that many power tool attachments may be used with a given output shaft 20. Also, the width of the annular ring 26 may be varied to have the inside diameter fit a number of different power tools. If the outer diameter 26A and the inner diameter 16 are too difficult to manufacture to the strict tolerances envisioned by the plastic and metal embodiments of the present invention, tolerance rings (not shown) could be used as the alignment ring 26 and/or in conjunction with the alignment ring 26.

Figure 4:
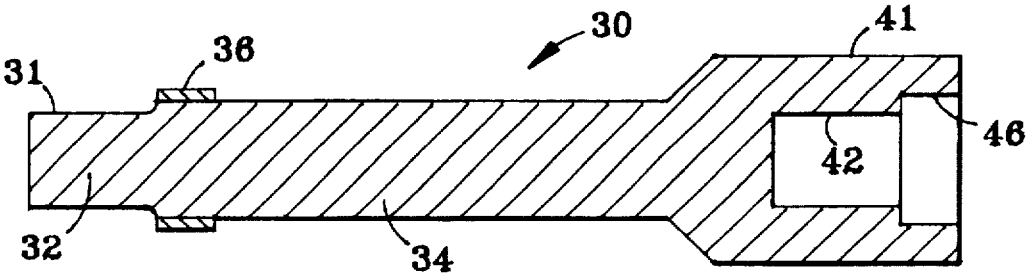
FIG. 4 is a cross-sectional view of a first preferred embodiment of the present invention as used on an extension.
Figure 5:
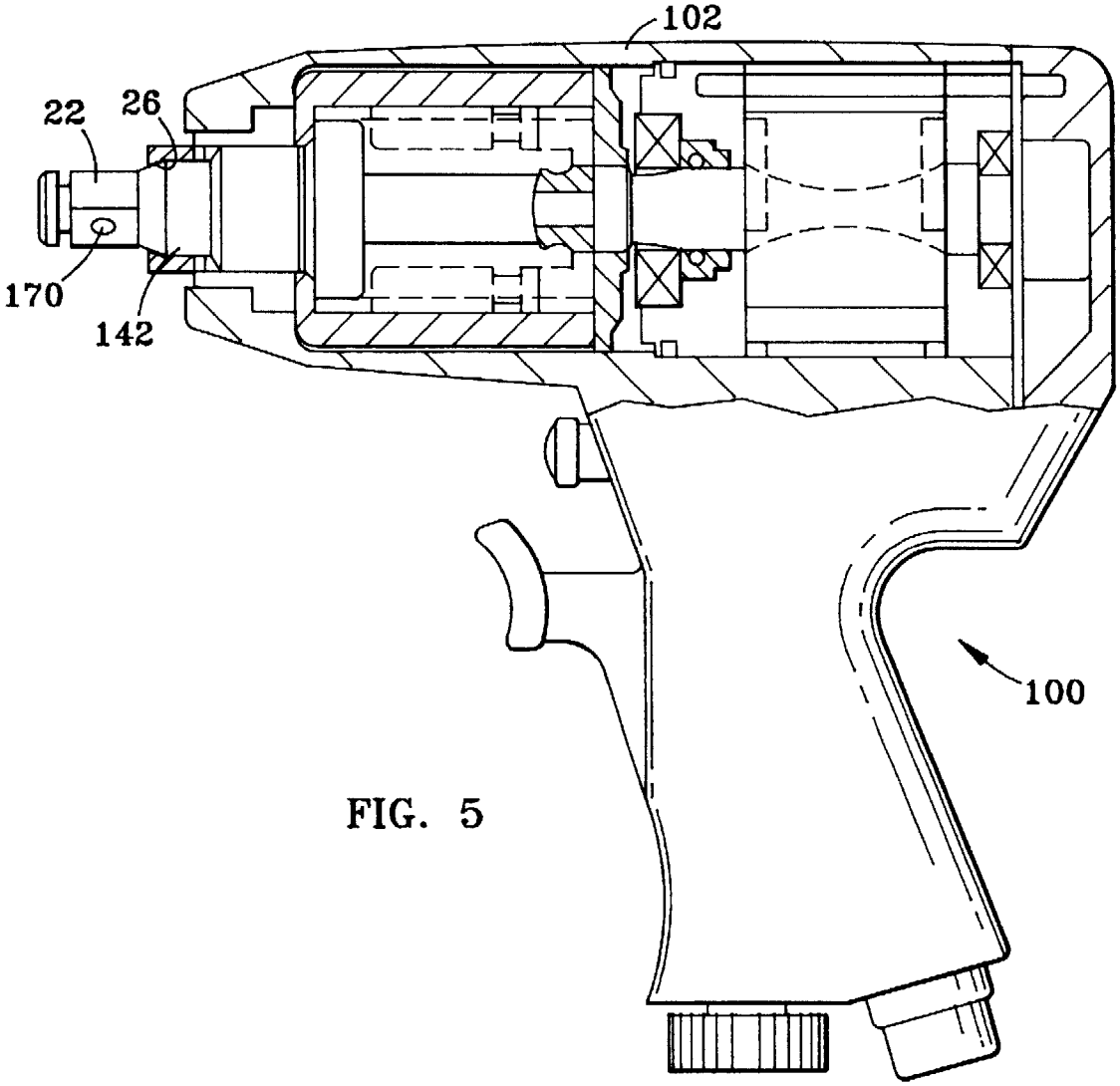
FIG. 5 is a partial cut away, side view of a power tool including an alignment device thereon.

An extension 30 having second end 31 and a first end 41 is depicted in FIG. 4 as being capable of performing both the function of the attachment 10 and the output shaft 20. The second end 31 functions as an output shaft in that it serves as a driver for a socket. The second end 31 comprises a vibrational dampening alignment ring 36 interference fit around the body 34 of the extension 30, seated just behind the drive 32. The first end 41 comprises a first bore 42 and a second bore 46 in consecutive, axial alignment. Because it is a power tool attachment 10, the first bore 42 is adapted to receive the drive 22 of an output shaft 20. The second bore 46 has a diameter corresponding to the outer diameter 26A (FIG. 3) of the alignment ring 26. This second bore 46 fits precisely around the ring in order to prevent wobble and decrease slippage of the extension 30 relative to the output shaft 20.

Figure 6:
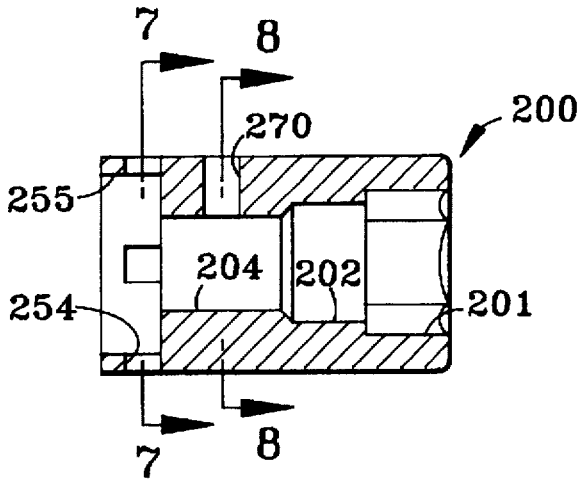
FIG. 6 is a side view cross section of a socket of a second preferred embodiment of the present invention.
Figure 7:
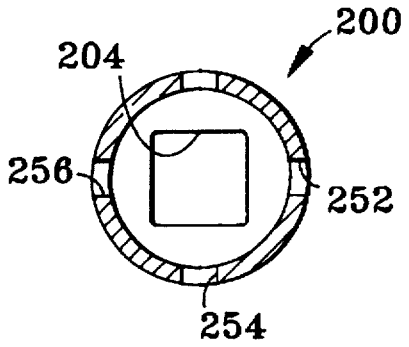
FIG. 7 is a cross-sectional view as taken through lines 7—7 of FIG. 6.
Figure 8:
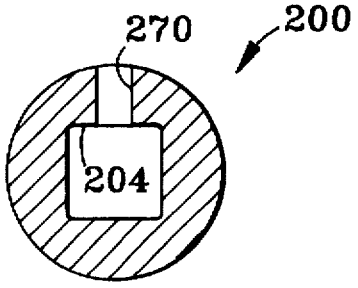
FIG. 8 is a cross-sectional view as taken through lines 8—8 of FIG. 6.
Figure 9:
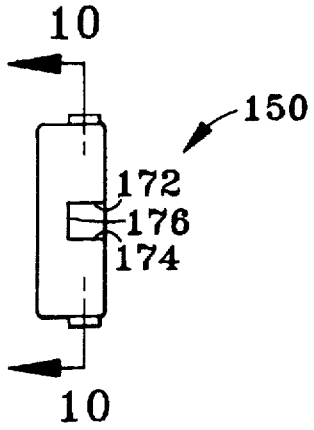
FIG. 9 is a side view of an alignment device of a second preferred embodiment of the present invention.
Figure 10:
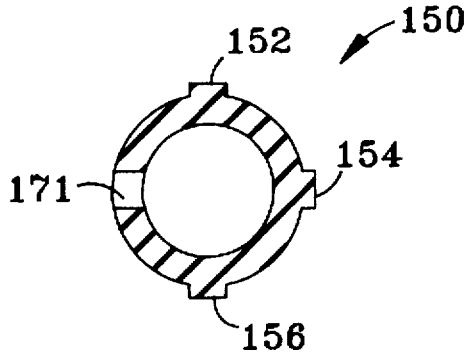
FIG. 10 is a cross-sectional view as taken through lines 10—10 of FIG. 10.
Figure 11:
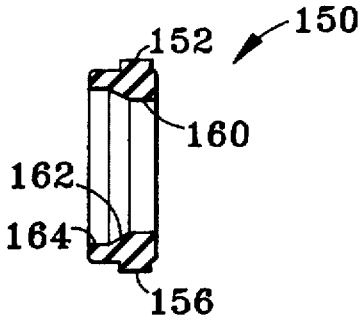
FIG. 11 is a cross-sectional view of an alignment device of a second preferred embodiment of the present invention.

FIG. 6 depicts a second embodiment of the present invention. FIG. 6 shows a socket 200 having an inner bore 202, 201 for engaging a hex nut. Bore 204 is shown which engages with the square drive of a power tool 100. Pin retainer opening 270 is shown for engagement with the pin retainer 170 on the square drive 22 of a power tool 100. Proximate the square drive bore 204 is a second bore 255 for insertion of an alignment ring 150. The alignment ring bore 255 includes a plurality of holes 252, 254, and 256 as shown in FIG. 7. An alignment ring 150 is inserted into the bore 255 and engaged therein by protuberances or nubs 152, 154 and 156 as shown in FIGS. 9–11. The nubs or protuberances 152, 154 and 156 assist the alignment ring from vibrating out of the socket 200 during use. The protuberances 152, 154 and 156 also prevent rotation of the alignment ring within the bore 255. Optionally, locking members other than protuberances may be used, such as a hex surface, spline surface, a rubber with embedded grit, and the like.

Alignment ring 150 includes a slot 171. The slot 171 includes side walls 172, 174 and 176. The alignment ring 150 includes an inner surface of varying size (diameter). The inner surface 160, 162 and 164 is of varying size (diameter) so as to fit onto the output shaft of a power tool as shown in FIG. 5. For instance, as shown in FIG. 11, a ring 150 includes tow cylindrical portions 160, 164 with an interposed frustoconical portion 162 to mate with a particular anvil 142 of a power tool, as shown in FIG. 5. The inner surface 160, 162, 164 may also take on other varying geometries so as to fit onto and adapt to varying size output shafts. It should also be recognized that various rings 150 are manufactured having varying size (thickness) so that one may select a ring 150 for a given output shaft of a given tool. This variation in the thickness of the output shaft allows one socket to fit many different tools simply by replacing the alignment ring 150 in the given socket. The alignment ring 150 is made of a flexible material, such as nitrile rubber, which has vibration absorbing properties. The resiliency or flexibility of the material is important for ease of insertion into and removal from the socket 200.

Upon use, an alignment ring 150 is selected for an output shaft having a particular geometry. Once the proper alignment ring is selected, it is inserted into the attachment device, such as socket 200. The alignment ring 150 and socket 200 are then inserted over the output shaft of an anvil 22. In certain instances, the anvil has a pin retainer 170 as shown in FIG. 5. In order for the combined alignment ring 150 and socket 200 to fit over the output shaft 22, the pin retainer 170 must be depressed. The alignment ring 150 has a slot 171 therein so that the pin retainer 170 may be depressed. The pin retainer 170 is depressed by inserting a pin or other type of device into the slot 171. When the pin retainer 170 is depressed the socket may be slid onto the output shaft of the power tool and engage the pin retainer opening 270.

The foregoing description of the preferred embodiments of the invention have been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be within the scope of this invention as defined by the accompanying claims.

Accordingly, what is claimed is:

1. An accessory adapted for use with a pneumatic tool comprising:

a slotted alignment ring having a plurality of protuberances extending therefrom; and a pneumatic tool attachment, said attachment including a first bore sized for mounting said tool attachment on said pneumatic tool, and a second bore larger than said first bore and sized for mounting said alignment ring therein, said tool attachment also including a plurality of holes extending therethrough from the second bore for receiving the plurality of protuberances of the slotted alignment ring.

2. The accessory according to claim 1, wherein the alignment ring has a non-circular cross-section.

3. The accessory according to claim 2, wherein the attachment is selected from the group consisting of a socket and an extension.

4. A method for making an accessory adapted for use with a power tool having an output shaft, said method comprising:

providing an attachment for a power tool having a first bore sized to fit a drive portion of the output shaft;

forming a second bore in said attachment;

providing an alignment device, having an outer surface sized to engage an inner surface of said second bore; and selectively forming an at least partially cylindrical inner surface on said alignment device conforming to a body of said output shaft, whereby said inner surface of said alignment device may be selectively conformed to various sized output shaft bodies.

5. An alignment device produced by the method of claim 4.

6. A method for making a wobble inhibiting accessory for a power tool having a motor and a rotatable output shaft, said method comprising:

providing an attachment having a first bore sized to fit a first drive portion of the rotatable output shaft of the power tool;

forming a second bore in said attachment of a different shape than the first bore;

providing an alignment device defined by an annular band and having an outer surface sized to engage an inner surface of said second bore;

forming an inner surface on said alignment device conforming to a geometry of said rotatable output shaft of the power tool; and disposing the alignment device into a lining configuration of and with the second bore.

* * * * *